United States Patent [19]

Yamaoka et al.

[11] 4,403,125

[45] Sep. 6, 1983

[54] GAS-INSULATED DISCONNECTING SWITCH

[75] Inventors: Yukinori Yamaoka, Hitachi; Seizo Nakano, Mito; Sigetaka Takeuchi, Hitachi; Kazuaki Oishi, Hitachi; Koji Sasaki, Hitachi, all of Japan

[73] Assignee: Hitachi, Ltd., Tokyo, Japan

[21] Appl. No.: 234,406

[22] Filed: Feb. 13, 1981

[30] Foreign Application Priority Data

Feb. 16, 1980 [JP] Japan ..... 55-18252
Feb. 16, 1980 [JP] Japan ..... 55-18253

[51] Int. Cl.[3] ..... H01H 9/30
[52] U.S. Cl. ..... 200/144 R; 200/148 R
[58] Field of Search ..... 200/148 R, 148 G, 144 R, 200/148 B

[56] References Cited

U.S. PATENT DOCUMENTS 3,114,814 12/1963 Stettner ..... 200/144 X
4,228,332 10/1980 Ibuki ..... 200/148 B

*Primary Examiner*—A. T. Grimley
*Assistant Examiner*—Morris Ginsburg
*Attorney, Agent, or Firm*—Antonelli, Terry & Wands

[57] ABSTRACT

An insulating gas-filled disconnecting switch comprises a metallic container filled hermetically with an insulation gas, and a movable electrode and a stationary electrode disposed within the metallic container and electrically insulated from the latter. Means for guiding an arc possibly produced between both electrodes upon separation of the movable electrode from the stationary electrode positively toward a center portion of an opposite end of the stationary electrode, to thereby prevent the arc propagation toward the stationary electrode from reaching the metallic container from the stationary electrode.

20 Claims, 11 Drawing Figures

GAS-INSULATED DISCONNECTING SWITCH

BACKGROUND OF THE INVENTION

1. Field of the Invention

The present invention relates to an improvement of a gas-insulated (or insulating gas-filled) disconnecting switch. In particular, the invention concerns an improvement of the disconnecting switch which is effective for preventing a ground fault due to arc-over which may possibly be produced in a circuit opening operation.

2. Description of the Prior Art

Usually, the disconnecting switch is employed in a power transmission system in combination with a circuit breaker. When a power line is to be opened, a main circuit is first opened by means of the circuit breaker and the disconnecting switch is subsequently opened in a substantially dead state (i.e. no-current state). However, there arises recently some applications where the disconnecting switch is to be opened and/or closed in a live state in which a line charge current of the order of several amperes is present. Under the circumstance, it is required that the disconnecting switch has a performance to deal with such operation.

Generally, the gas-insulated disconnecting switch is configured such that a disconnector including a movable electrode and a stationary electrode is mounted in an electrically insulated state within a metallic container which is grounded and filled with a high insulation gas in a hermetically sealed manner. The relative speed of the movable electrode to the stationary electrode for separating the former from the latter (this speed will hereinafter be termed as "separating speed") is relatively low in a range of 0.5 m/s to 1.5 m/s. Further, the disconnecting switch is not imparted with a powerful arc-extinguishing performance. Consequently, when the charge current of a high voltage line is to be broken in the live state by means of the disconnecting switch of the structure mentioned above, arc will be repeatedly produced between the movable electrode and the stationary electrode as the former is being separated from the latter until the distance between both electrodes (hereinafter called as "inter-electrode distance") has attained a sufficient length. Such arc-over will provide no problems so far as the arcing is confined within the space between both electrodes. However, the inventors have found that in the conventional insulating gas-filled disconnecting switch, there arises such case where the arc reaches the grounded metal container from one of the electrodes in the circuit opening operation, resulting in a ground fault and giving rise to serious problems.

SUMMARY OF THE INVENTION

An object of the invention is to provide a gas-insulated or insulating gas-filled disconnecting switch of the type in which a disconnector including a stationary electrode and a movable electrode is mounted in an electrically insulated manner within a metallic container grounded to the earth and hermetically filled with an insulation gas, wherein provisions are made for preventing arc produced between both electrodes upon separating operation thereof in the live state from reaching the metallic container, to thereby suppress the ground fault.

According to an aspect of the invention, it is proposed for the gas-insulated disconnecting switch of the type described above that the arc produced in the separating process of the electrodes is forcibly guided so as to be directed toward the center portions of the oppositely disposed ends of both electrodes, thereby to prevent the arc produced between both electrode from proceeding toward the grounded metallic container.

DESCRIPTION OF THE PREFERRED EMBODIMENTS

Figure 1:
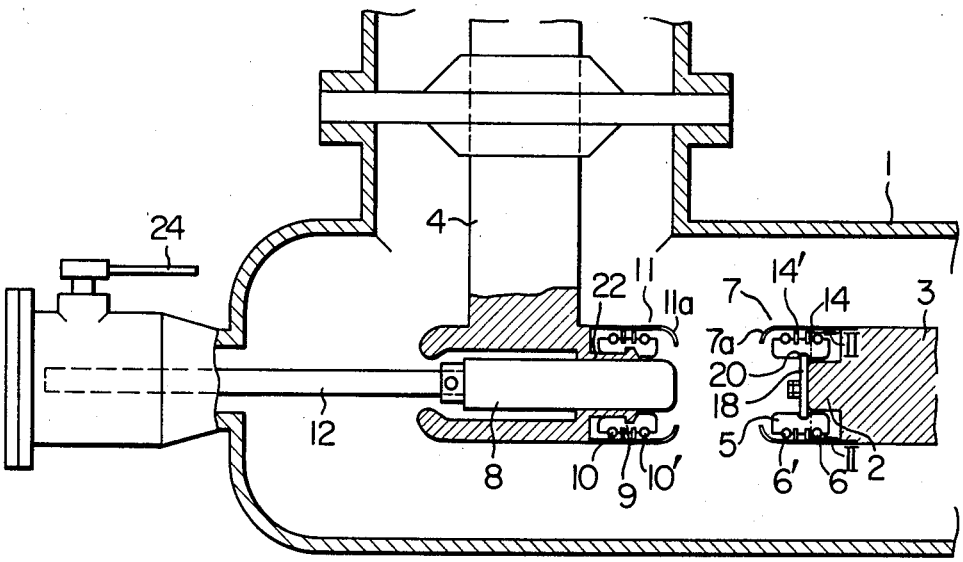
FIG. 1 PRIOR ART
FIG. 1 is a longitudinal sectional view showing a general arrangement of gas-insulated disconnecting switch.
Figure 2:
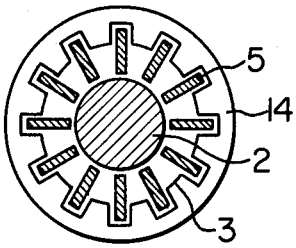
FIG. 2 PRIOR ART
FIG. 2 is a cross-sectional view taken along the line II—II in FIG. 1.

Before entering into the detailed description of a structure of the disconnecting switch according to the invention, a typical fundamental structure of an insulating gas-filled disconnecting switch will be described by referring to FIGS. 1 and 2. In FIG. 1, reference numeral 1 denotes a metallic container which is grounded to the earth and hermetically filled with an electrically insulating gas such as $SF_6$ under pressure. Disposed within the container 1 are high voltage conductors 3 and 4 which constitute a main current path or circuit and which are connected to a high voltage line of a power transmission system (not shown). The conductors 3 and 4 are electrically insulated from the metallic container 1. The disconnecting switch comprises a disconnector composed of a stationary electrode and a movable electrode provided at free ends of the conductors 3 and 4, respectively. The stationary electrode includes a plurality of stationary contact elements 5 disposed radially around a cylindrical end portion of the conductor 3. The contact elements 5 have respective outer peripheral edges which are received in grooves formed in a comb-like array in the inner peripheries of a pair of annular clamping plates 14 and 14' juxtaposed to each other, while the inner edge portion of the contact elements 5 are formed with respective grooves 20 in a circular alignment with each other to receive therein an outer periphery of a disc plate 18 which in turn is fixedly secured to the end face of the conductor 3, whereby the contact elements 5 are mounted integrally and held immovable in any direction. On the other hand, the movable electrode includes a rod-like movable contact member 8 mounted slidably within a hollow cylindrical end portion 22 formed integrally with the free end of the conductor 4 and a plurality of contact elements 9 for electrically connecting the movable contact member 8 to the cylindrical end portion 22 of the conductor 4. The contact elements 9 are arranged in a manner similar to the aforementioned contact elements 5 and pressed against the peripheral surface of the cylindrical end portion 22 of the conductor 4 by means of an annular spring member 10 on one hand and against the peripheral surface of the movable contact member 8 by means of another annular spring 10′ on the other hand. The rod-like movable contact member 8 is mechanically coupled at one end thereof to an electrically insulative manipulator rod 12 which can be moved reversibly along its longitudinal axis through an external manipulating mechanism 24. The movable contact member 8 is positioned in longitudinal alignment with the stationary electrode described above. When the movable contact member 8 is moved toward the stationary electrode, the projecting end portion of the former is forcibly pushed into a space defined by the radial array of the contact elements 5 of the stationary electrode, whereupon the contact elements 5 are pressed into contact with the peripheral surface of the engaged end portion of the contact member 8 under the pressure exerted by annular springs 6, 6′. In this manner, a main current path is formed as extending from the conductor 4 through the contact elements 9, movable contact member 8 and the contact elements 5 to the conductor 3. The stationary electrode and the movable electrode have respective shields 7 and 11 mounted around the respective contact elements 5 and 9. Each of the shields 7 and 11 is of a cup-like configuration having a bottom formed with an aperture to allow the contact member 8 to pass therethrough upon longitudinal movement thereof. The shoulder portion or bottom peripheral portion 7*a* or 11*a* of each of the shield members 7 and 11 is imparted with an appropriate curvature to reduce the intensity of electric field generated upon energization of the associated electrode. It should be mentioned that the contact elements, shield members and the movable contact members may be made of copper and coated with gold or like over the surfaces thereof, if desired.

The above-mentioned principal or fundamental structure of the insulating gas-filled (or gas-insulated) disconnecting switch is substantially applied to the one according to the invention, as well as to the conventional one except for the configurations of the individual components of the movable and the stationary electrodes. Under the circumstance, description will be made only about these portions which are improved according to the invention by comparing with the corresponding portions of the conventional disconnecting switch in order to facilitating the understanding of the invention.

Figure 3A:
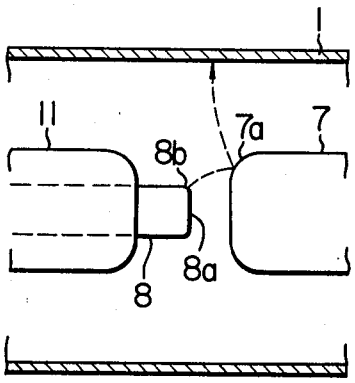
FIG. 3a PRIOR ART
FIGS. 3*a* and 3*b* are schematic views to illustrate hitherto known structure of parts which correspond to essential ones of the gas-insulated disconnecting switch according to the invention.
Figure 3B:
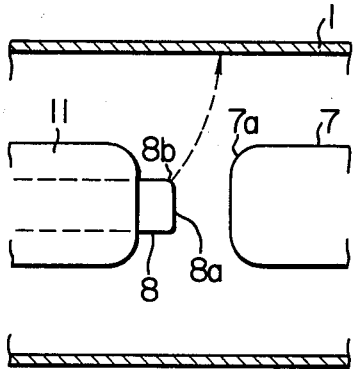
FIG. 3b PRIOR ART

FIGS. 3*a* and 3*b* show fragmentally and schematically only the metallic container 1, the movable contact member 8 and the shields 7 and 11 of a conventional disconnecting switch. As can be seen from these figures, the rod-like movable contact member 8 of the conventional disconnecting switch has an end face 8*a* which is formed substantially flat at a center portion thereof to facilitate its fabrication, while a peripheral edge portion 8*b* of the end face 8*a* is rounded with a small curvature for the purpose of facilitating contact with the contact elements 5 of the stationary electrode. When the movable contact member 8 is separated from the stationary electrode for opening the main circuit or current path in the live state, the intensity of electric field is strong in the vicinity of the rounded peripheral edge portions 8*b* to bring about dielectric breakdown at this region, which will eventually give rise to occurrence of arc-over between the peripheral edge portion 8*b* of the movable contact member 8 and the shoulder portion 7*a* of the shield 7 of the stationary electrode. Because the shield 7 is ineffective for damping the intensity of electric field produced by the arc-over in the manner as abovementioned, the field intensity is increased in the vicinity of the shoulder portion 7*a*, resulting in that the dielectric breakdown proceeds toward the metallic container 1 which is grounded to the earth. In this way, a short-circuit is first formed by arc-over between the movable contact member 8 of a high potential and the stationary electrode along the path indicated by a broken line in FIG. 3*a*, which develops a direct arc-over between the metallic container 1 and the contact member 8 as indicated by a broken line in FIG. 3*b* to bring about a ground fault.

In this conjunction, it might be easily conceived that the ground fault described above could be prevented by increasing the separating speed of the movable contact member so that a distance which is long enough to extinguish the arc-over is attained between the movable contact member 8 and the shield 7 before the arc-over proceeds toward and reaches the metallic container 1 from the shield 7. However, in order to make the separating speed of the movable contact member 8 sufficiently high, a complicated structure of the manipulating mechanism, having an increased mechanical strength, would be required for the disconnecting switch, and would involve a higher expense as well as an increased size of the overall structure of the disconnecting switch. Accordingly, it is contemplated, with the present invention, to prevent a ground fault, due to the arc-over described above, by improving the configuration of the movable electrode and/or the stationary electrode without changing the manipulating or operating mechanism itself.

Figure 4:
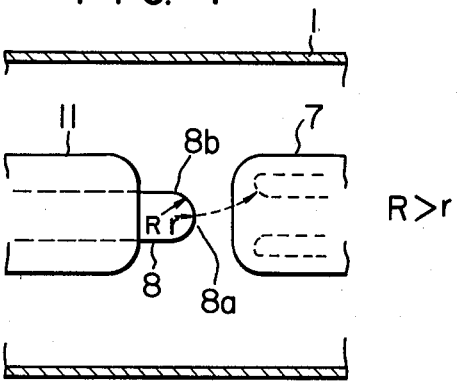
FIG. 4 schematically illustrates a structure of the gas-insulated disconnecting switch according to an embodiment of the invention.

According to an embodiment of the invention, the configuration of the free end portion of the movable contact member 8 is profiled such that a curvature r of a portion 8*a* around the center axis of the member 8 (this portion 8*a* will hereinafter be referred to as the center axis portion) is smaller than a curvature R of a peripheral end portion 8*b* of the movable contact member 8 remote from the center axis thereof, as is illustrated in FIG. 4. When the movable contact member 8, having such an end configuration as described just above, is separated from the stationary electrode, the intensity of the electric field at the end of the movable contact member 8 becomes maximum at the center axis portion 8*a*, whereby the dielectric breakdown is developed in a manner indicated by broken lines in FIG. 4. In other words, the arc-over proceeds toward the center of the stationary electrode, i.e. toward the contact elements 5 disposed within the shield 7. Thus, the dielectric breakdown is positively prevented from proceeding to the metallic container by virtue of the shielding effect of the shield 7, even when the arc-over occurs between the movable contact member 8 and the stationary contact elements 5.

Figure 5A:
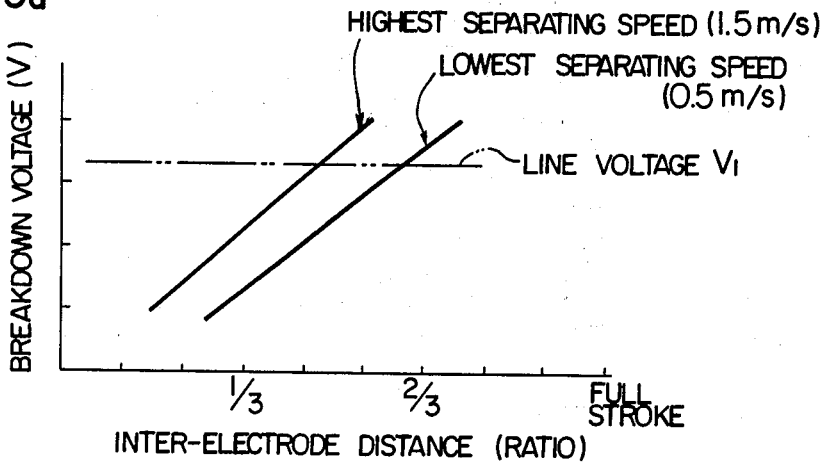
FIGS. 5*a*, 5*b* and 5*c* illustrate the basic principle of the invention.
Figure 5B:
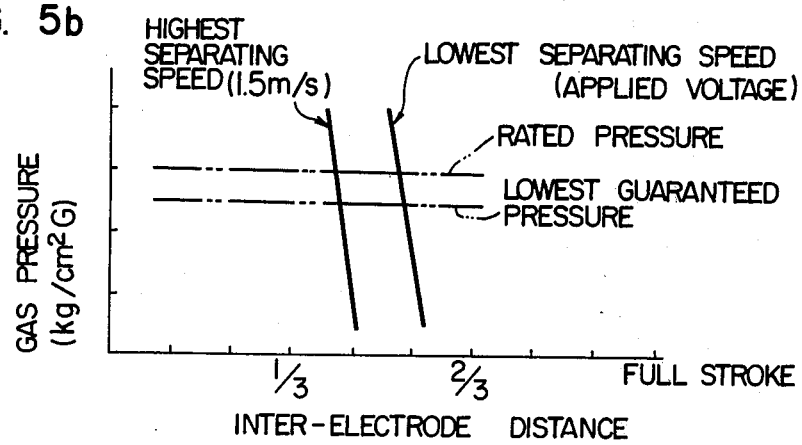
Figure 5C:
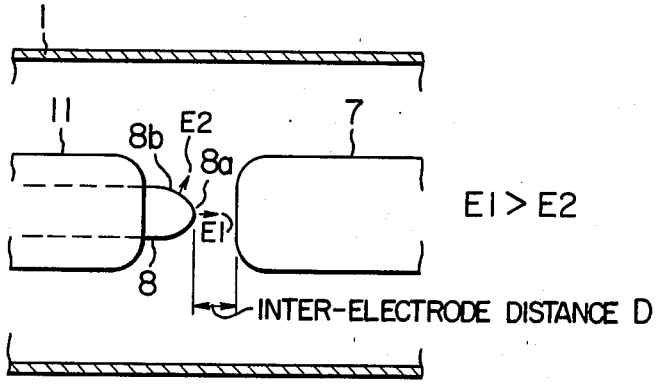

For further particulars, explanation will be made on the insulation characteristics in the separating process of the movable contact member of the disconnecting switch by referring to FIGS. 5*a*, 5*b* and 5*c*. FIG. 5*a* graphically illustrates relationships between the inter-electrode distance D and the breakdown voltage V at which the dielectric breakdown occurs between the electrodes with the distance D in the separating process of the movable contact member. The inter-electrode distance (i.e. the distance between the movable and the stationary electrodes) is represented by the ratio of the distance D between the center axis portion 8*a* of the movable contact member 8 and a plane containing the end face of the shield 7 to a full stroke of the movable contact member, as can be seen from FIG. 5*c*. The dielectric breakdown voltage V varies in dependence on the separating speed of the movable contact member 8. In FIG. 5*a*, the insulation characteristics are shown for the highest separation speed of 1.5 m/s and the lowest speed of 0.5 m/s. As can be seen from the figure, no dielectric breakdown will take place at a line voltage $V_1$ even for the lowest separation speed when the inter-electrode distance exceeds two thirds ($\frac{2}{3}$) of the full stroke. Accordingly, in the case of the embodiment described above, the curvatures of the center axis portion 8*a* and the peripheral portion 8*b* are selected such that the field intensity $E_1$ at the center axis portion 8*a* is higher than the field intensity $E_2$ at the peripheral portion 8*b* before the inter-electrode distance reaches the threshold value, i.e. two thirds ($\frac{2}{3}$) of the full stroke of the movable contact member 8, whereby any dielectric breakdown which may occur before the inter-electrode distance exceeds two thirds of the full-stroke of the movable contact member will proceed to the center portion of the opposite stationary electrode within the shield 7, so that the arc-over to the metallic container 1 can be suppressed by the shielding effect of the shield 7.

Next, another exemplary embodiment of the invention will be described by referring to FIG. 6, in which components common to those shown in FIG. 1 are denoted by the same reference numerals. In the case of the embodiment shown in FIG. 6, the movable contact member 8 is imparted with the same configuration as that of the conventional disconnecting switch, while the configuration of the stationary electrode is modified. More particularly, a metallic arcing member 32 made of copper or the like is provided around the contact elements 5 in a position to partially enclose them. At a glance, the arcing member 32 may look like the shield 7 shown in FIG. 7. It should, however, be noted that the arcing member 32 differs from the shield 7 in respect of the geometrical configuration of the end portion as well as the function, as will be described hereinafter. Disposed around the arcing member 32 is a shield 30 which serves a function substantially similar to that of the shield 7 shown in FIG. 1, but has an enlarged open end so as to enclose the arcing member 32. The function of the arcing member 32 is to positively direct or guide toward the open end portion 32*a* of the arcing member 32, the dielectric breakdown which may occur between the end of the movable contact member 8 and the stationary electrode. To this end, the curvature of the end portion 32*a* of the arcing member 32 is selected smaller than that of the end portion 30*a* of the shield 30 so that the field intensity $E_2$ in the vicinity of the end portion 32*a* of the arcing member 32 remains higher than the field intensity $E_1$ prevailing in the vicinity of the end portion 30*a* of the shield 30 until the inter-electrode distance reaches the threshold value. With such arrangement, the dielectric breakdown occuring at the free end of the movable contact member 8 is guided or directed toward the end portion 32*a* of the arcing member 32 and prevented from proceeding to the metallic container 1 by virtue of the shielding action of the shield 30. In this conjunction, it is preferred that the outer surface of the shield 30 is coated with an insulative paint layer 34 of Teflon or the like to thereby reduce the intensity of electric field near the outer surface of the shield 30.

Figure 6:
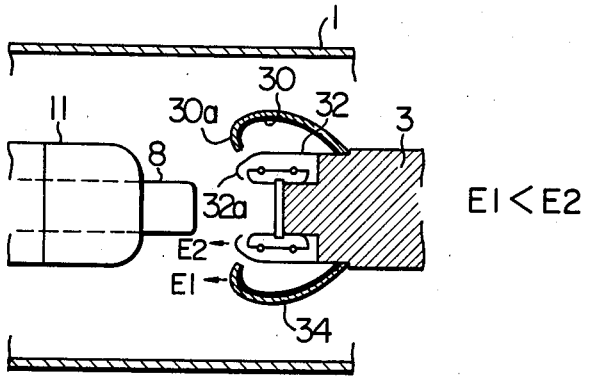
FIGS. 6, 7 and 8 schematically illustrate other embodiments of the invention.
Figure 7:
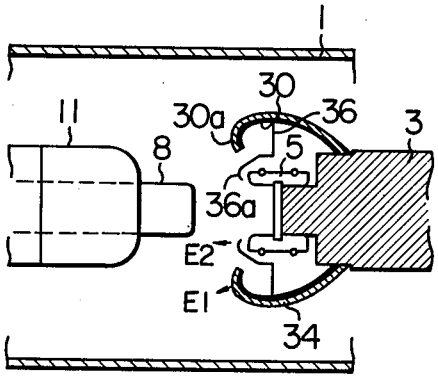

In the embodiment shown in FIG. 6, the arcing member 32 is fixedly secured to the conductor 3. However, the arcing member may be formed integrally with the shield 30. A modification to this end is shown in FIG. 7. The arcing member 36 is formed integrally with the shield 30, wherein the curvature of the free end portion 36*a* of the arcing member 36 is selected smaller than that of the end portion 30*a* of the shield 30 so that the intensity of electric field in the vicinity of the end portion 36*a* is higher than the field intensity in the vicinity of the end portion 30*a*. With this arrangement, the dielectric breakdown occurring at the end of the movable contact member 8 can be positively guided or directed toward the end portion 36*a* of the arcing member 36, as is in the case of the arrangement shown in FIG. 6.

Figure 8:
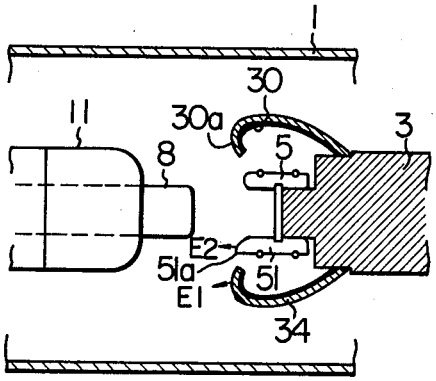

Referring to FIG. 8 which shows a further exemplary embodiment of the invention, one or more, preferably a pair of symmetrically disposed contact elements 51 are employed in place of the additionally provided arcing members shown in FIGS. 6 and 7. More specifically, the contact elements 51 have a greater length than the conventional elements 5 so that the free end portions of the contact elements 51 project toward the movable electrode to a greater extent than the conventional contact elements 5. Further, the curvature of the projecting end 51*a* of the contact element 51 is dimensioned smaller than that of the end portion 30*a* of the shield 30 so that the field intensity in the vicinity of the end portion 51*a* is higher than the field intensity near the end portion 30*a*. With such arrangement, an action and effect similar to that of the structures shown in FIGS. 6 and 7 can be obtained.

In any one of the embodiments described in the foregoing, it is desirable that those portions at which the arc is emitted and terminated, such as the end portions of the movable contact member and the arcing member, should be reinforced by a Cu-W alloy or the like. In the embodiments shown in FIGS. 6, 7 and 8, the end portion of the movable contact member 8 may of course be configured or profiled in the same manner as the one shown in FIG. 4.

In the foregoing, the invention has been described in conjunction with the exemplary embodiments shown in the drawings. However, it will be appreciated that the invention is never restricted to these embodiments, but various variations and modifications will be made without departing from the spirit and scope of the invention.

We claim:

1. A gas-insulated disconnecting switch comprising a metallic casing filled with an insulating gas in a hermetically sealed manner, a stationary electrode and a movable electrode disposed within said casing and electrically insuated from said casing, said electrodes being electrically connectable to an external power line for selectively opening or closing the power line, and guiding means being provided for at least one of said electrodes, at an end portion facing toward an end portion of the other electrode, for guiding a dielectric breakdown which may occur from the end portion of said movable electrode toward said stationary electrode, when said movable electrode is separated from said stationary electrode, in a manner causing the dielectric breakdown to be directed initially to a center portion of the end portion of said stationary electrode.

2. A gas-insulated disconnecting switch according to claim 1, wherein said guiding means includes a curved profile provided on the end portion of said movable electrode facing toward said stationary electrode, said curved profile being provided with a curvature at a center portion thereof that is smaller than a curvature provided at a peripheral portion thereof.

3. A gas-insulated disconnecting switch according to claim 2, wherein the curvatures at the center portion and the peripheral portion of the curved profile of the end portion of said movable electrode are selected such that the intensity of electric field in the vicinity of said center portion is higher than the field intensity prevailing in the vicinity of said peripheral portion until the distance between said movable electrode and said stationary electrode, upon separation of said movable electrode from said stationary electrode, reaches a predetermined value, called a threshold value of inter-electrode distance, which is the maximum value of the inter-electrode distance at which a dielectric breakdown may occur between said movable electrode and said stationary electrode.

4. A gas-insulated disconnecting switch according to claim 3, wherein said threshold value of the inter-electrode distance is selected equal to two thirds of a full separation stroke of said movable electrode relative to said stationary electrode.

5. A gas-insulated disconnecting switch according to claim 1, wherein said guiding means includes an end of a metallic arcing member mounted on said stationary electrode so as to be spaced from and surround a region of said stationary electrode at which said movable electrode is brought into contact with said stationary electrode, and a shield member disposed opposite to said movable electrode so as to be spaced from and surround said arcing member, said arcing member having an end portion formed with a smaller curvature than that of an end portion of said shield member.

6. A gas-insulated disconnecting switch according to claim 5, wherein the curvatures at the end portions of said arcing member and said shield member, respectively, are selected such that the intensity of electric field in the vicinity of the end portion of said arcing member is higher than the field intensity prevailing in the vicinity of the end portion of said shield member until the distance between said movable electrode and said stationary electrode, upon separation of said movable electrode from said stationary electrode, reaches a predetermined value, called a threshold value of inter-electrode distance, which is the maximum value of distances at which a dielectric breakdown may occur between said movable electrode and said stationary electrode.

7. A gas-insulated disconnecting switch according to claim 5, wherein an outer surface of said shield member, facing toward said metallic casing is applied with a coating of an insulative material.

8. A gas-insulated disconnecting switch according to claim 5, wherein said arcing member and said shield member are secured to a conductor for connecting said stationary electrode to the external power line.

9. A gas-insulated disconnecting switch according to claim 5, wherein said shield member is secured to a conductor for connecting said stationary electrode to the external power line, while said arcing member is secured to the inner side of said shield member.

10. A gas-insulated disconnecting switch according to claim 1, wherein said guiding means includes a projecting portion formed on said stationary electrode at a portion of a region where said movable electrode is brought into contact with said stationary electrode, said portion of said region projecting toward said movable electrode beyond a remaining portion of said region, at which that projecting portion is not mounted, and being formed with a smaller curvature than that of said remaining portion of said region.

11. A gas-insulated disconnecting switch according to claim 9, wherein the region of said stationary electrode where said movable electrode is brought into contact with said stationary electrode is provided with a plurality of contact elements disposed in an annular array so as to be adapted to contact with an outer surface of said movable electrode, at least one of said contact elements has an end portion projecting toward said movable electrode beyond end portions of the other contact elements.

12. A gas-insulated disconnecting switch according to claim 10, wherein the region of said stationary electrode where said movable electrode is brought into contact with said stationary electrode is provided with a plurality of contact elements disposed in an annular array so as to be adapted to contact with an outer surface of said movable electrode, said projecting portion comprising an end portion of at least one of said contact elements, said end portion of said contact element projecting toward said movable electrode beyond end portions of the other contact elements.

13. A gas-insulated disconnecting switch according to claim 11, wherein said annular array of contact elements is surrounded by a shield member that is spaced therefrom, an end profile of said shield member having a greater curvature than that of said projecting portion.

14. A gas-insulated disconnecting switch according to claim 5, wherein said guiding means includes a curved profile provided on the end portion of said movable electrode facing toward said stationary electrode, said curved profile being provided with a curvature at a center portion thereof that is smaller than a curvature provided at a peripheral portion thereof.

15. A gas-insulated disconnecting switch according to claim 11, wherein said guiding means includes a curved profile provided on the end portion of said movable electrode facing toward said stationary electrode, said curved profile being provided with a curvature at a center portion thereof that is smaller than a curvature provided at a peripheral portion thereof.

16. A gas-insulated disconnecting switch according to claim 1, wherein said movable electrode comprises a rod-like member.

17. A gas-insulated disconnecting switch according to claim 16, wherein said stationary electrode comprises a plurality of contacts disposed in an annular array so as to be adapted to contact with an outer surfce of the movable electrode and is surrounded by a shield member spaced therefrom.

18. A gas-insulated disconnecting switch according to claim 2, wherein said movable electrode comprises a rod-like member.

19. A gas-insulated disconnecting switch according to claim 18, wherein said stationary electrode comprises a plurality of contacts disposed in an annular array so as to be adapted to contact with an outer surface of the movable electrode and surrounded by a shield member spaced therefrom.

20. A gas-insulated disconnecting switch according to claim 1, wherein said guiding means is formed by constructing at least one of said electrodes in a manner that, from separation of the electrodes until a distance therebetween at which dielectric breakdown cannot occur is achieved, the electric field density prevailing at the periphery of said end portion thereof relative to the electric field density prevailing at a center portion of said end portion thereof is sufficiently different as to cause dielectric breakdown to be directed from the movable electrode to the center portion of the stationary electrode.

* * * * *